US011413217B2

(12) United States Patent
Elzik

(10) Patent No.: US 11,413,217 B2
(45) Date of Patent: Aug. 16, 2022

(54) CAPSULE CRUSHER DEVICE

(71) Applicant: Marline Elzik, Beaumont, CA (US)

(72) Inventor: Marline Elzik, Beaumont, CA (US)

( * ) Notice: Subject to any disclaimer, the term of this patent is extended or adjusted under 35 U.S.C. 154(b) by 337 days.

(21) Appl. No.: 16/791,013

(22) Filed: Feb. 14, 2020

(65) Prior Publication Data

US 2020/0323736 A1 Oct. 15, 2020

Related U.S. Application Data

(60) Provisional application No. 62/832,251, filed on Apr. 10, 2019.

(51) Int. Cl.
*A61J 7/00* (2006.01)

(52) U.S. Cl.
CPC ..... *A61J 7/0007* (2013.01)

(58) Field of Classification Search
CPC ..... A61J 7/0007
See application file for complete search history.

(56) References Cited

U.S. PATENT DOCUMENTS 2,572,378 A * 10/1951 Milton ..... F25C 5/046 241/199
3,915,393 A * 10/1975 Elkins ..... A61J 7/0007 241/168
4,824,000 A * 4/1989 Baxter ..... A61J 7/0007 225/93
5,472,421 A * 12/1995 Klearman ..... A61M 5/3129 604/82
5,823,451 A * 10/1998 Sharpe ..... A61J 7/0007 241/DIG. 27
5,863,001 A * 1/1999 Schulze ..... A61J 7/0007 241/DIG. 27
5,915,637 A * 6/1999 Parsons ..... A61J 7/0007 241/168
5,924,636 A * 7/1999 Calderon ..... A61J 7/0007 241/84.3
6,059,209 A * 5/2000 Barson ..... A61J 7/0007 241/168
D453,044 S * 1/2002 Buckley ..... D24/220
6,637,683 B1 * 10/2003 (Lomax) Wilbur ... A61J 7/0007 241/DIG. 27
6,637,685 B1 * 10/2003 Kruger ..... A61J 7/0007 241/DIG. 27
6,966,509 B2 * 11/2005 Janzen ..... A61J 7/0007 241/DIG. 27
D533,661 S * 12/2006 Yip ..... D24/133
(Continued)

*Primary Examiner* — Faye Francis

(57) ABSTRACT

A capsule cutter device having a pliers-type design with two handles which open and close about a cylindrical pin is implemented to manipulate a head to crush pills, capsules, tablets, and the like. In typical implementations, the capsule cutter device may be comprised of metal such as steel, stainless steel, brass, copper, titanium, etc. The handles of the capsule cutter device may include an overlay material, such as rubber, to increase a user's comfort and grip during use. The pin about which the handles open and close may at least in part attach the handles to each other and extend along a horizontal axis of the head of the capsule cutter device. The pin may include a cylindrical pin that is secured on opposing sides using a head to secure components together and enable opening and closing.

7 Claims, 4 Drawing Sheets

(56) References Cited

U.S. PATENT DOCUMENTS

| | | | | |
|---|---|---|---|---|
| 7,252,254 | B1 * | 8/2007 | Engel | A61J 7/0007 241/168 |
| 7,364,102 | B2 * | 4/2008 | Engel | A61J 7/0007 241/DIG. 27 |
| 9,044,046 | B2 * | 6/2015 | Jalet | A47J 19/06 |
| 10,792,223 | B1 * | 10/2020 | Lamaster | A61J 1/035 |
| 2002/0179669 | A1 * | 12/2002 | Buckley | B26D 1/30 225/93 |
| 2005/0133645 | A1 * | 6/2005 | Janzen | A61J 7/0007 241/169 |
| 2007/0164141 | A1 * | 7/2007 | Engel | A61J 7/0007 241/169.2 |
| 2008/0011803 | A1 * | 1/2008 | Petrie | B26D 3/30 225/103 |
| 2008/0093490 | A1 * | 4/2008 | Donovan | A61J 7/0007 241/169.2 |
| 2008/0314919 | A1 * | 12/2008 | Wheeler | B65B 69/0058 241/101.2 |
| 2017/0273868 | A1 * | 9/2017 | Wang | B26D 5/10 |
| 2019/0105231 | A1 * | 4/2019 | Doretti | A61J 7/0007 |
| 2020/0188231 | A1 * | 6/2020 | Casner | A61J 7/0007 |

* cited by examiner

CAPSULE CRUSHER DEVICE

BACKGROUND

Some people, such as young children, the elderly, and the disabled, have trouble or are incapable of swallowing whole pills. Sometimes a caregiver is forced to manually crush a pill into smaller pieces using, for example, a fork, spoon or knife, so that a patient is able to take their medication. This can be time-consuming and dangerous if, for example, the patient does not have someone who can crush the pill for them or if some of the pill's remnants are unintentionally lost.

SUMMARY

A capsule cutter device having a pliers-type design with two handles which open and close about a cylindrical pin is implemented to manipulate a head to crush pills, capsules, tablets, and the like. In typical implementations, the capsule cutter device may be comprised of metal such as steel, stainless steel, brass, copper, titanium, etc. The handles of the capsule cutter device may include an overlay material, such as rubber, to increase a user's comfort and grip during use. The pin about which the handles open and close may at least in part attach the handles to each other and extend along a horizontal axis of the head of the capsule cutter device. The cylindrical pin may be secured in place using heads on opposing ends to keep the various components intact. The capsule cutter device is a one piece set and, once manufactured for use, is not configured to be taken apart.

The head of the capsule cutter device includes a fixed jaw and a movable jaw that are positioned opposite each other at least when in the closed position. The fixed jaw forms a cavity with holes on a surface thereof, inside which the capsule is received and positioned. The movable jaw includes a bladed jaw section and a cleanup jaw section. The bladed jaw section forms a surface with protruding blades that at least in part mates with the cavity of the fixed jaw. The cleanup jaw section includes cylindrical pegs which engage with the holes on the surface of the fixed jaw.

A fixed arm of the handle may control the fixed jaw and a movable arm of the handle may control the movable jaw. The movable jaw opens with the movable handle to thereby enable a user to open the capsule cutter device and thereby place a capsule inside the cavity of the fixed jaw. The user can then close the movable arm which causes the bladed jaw section to engage with the fixed jaw, in which the capsule becomes sliced by the multiple blades on the bladed jaw section.

Holes on the surface of the fixed jaw allows some of the cut capsule to seep through. The cleanup jaw section of the movable jaw has cylindrical pegs that are controllable via the movable jaw. The cylindrical pegs may correspond to a shape and size of the holes on the surface of the fixed jaw. The cylindrical pegs may insert into the holes to enable a user to eject particles left behind during the capsule cutting actions. Once the capsule is cut and/or crushed, a user can ingest the capsule's remnants to make swallowing and ingestion easier.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
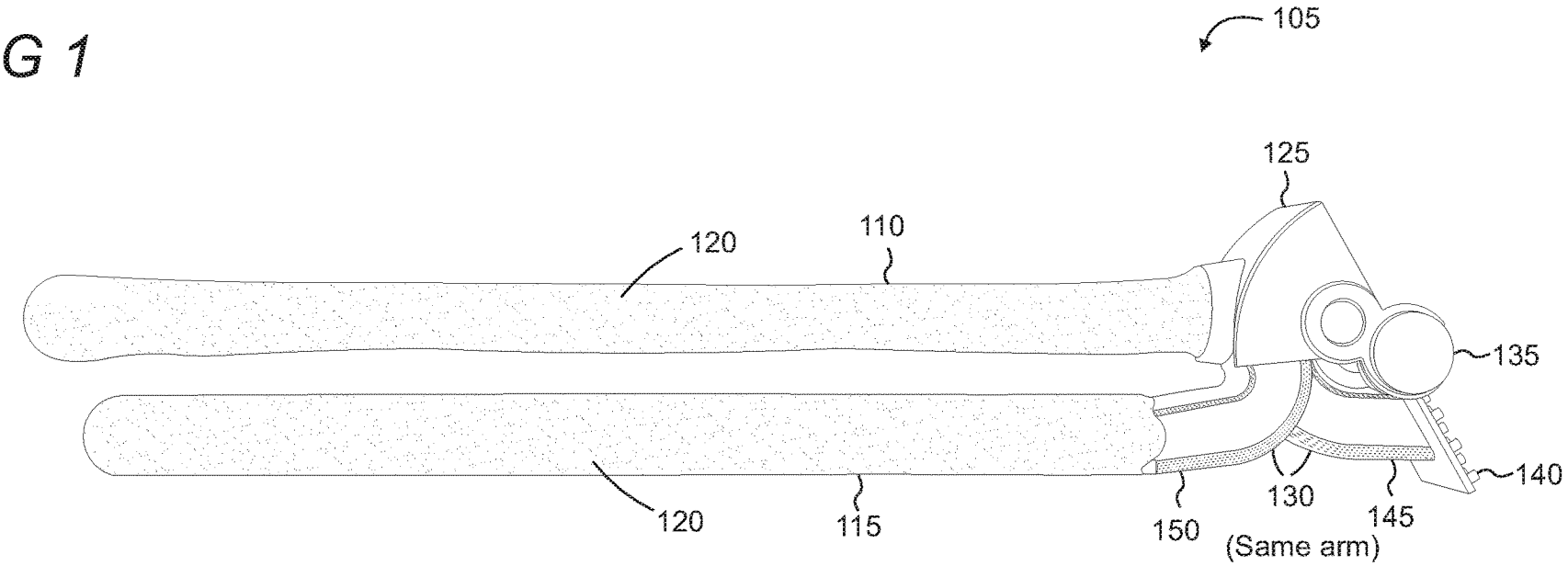
FIG. 1 shows an illustrative representation of a capsule cutter device having two arms.

FIG. 1 shows an illustrative representation in which a capsule cutter device 105 has two plier-type gripping arms used to crush pills for people who have trouble swallowing whole pills. The capsule cutter device has a fixed arm 110 and a movable arm 115, each of which has a rubber or silicon coating 120 to improve grip. In typical implementations, the capsule cutter device, including the jaws and gripping arms, may be comprised of a metal material such as steel, stainless steel, titanium, and the like to provide sufficient support when crushing a pill.

The fixed arm 110 is attached to a fixed jaw 125 and the movable arm 115 is attached to the movable arm 130. A head 135 keeps in place a cylindrical pin (not shown), which horizontally extends from one end of the capsule cutter device 105 to the other. The jaws may rotate about the pin as discussed in greater detail below. While "movable" and "fixed" are utilized herein to reference the various components of the capsule cutter device 105, either arm can technically move relative to the other arm depending on the user's preference. Thus, usage of the terms fixed and movable to reference specific arms or jaws are used for clarity in exposition.

The movable jaw 130 includes two sections which are each controllable via the same movable arm 115: a bladed jaw section 150 and a cleanup jaw section 145. The cleanup jaw section includes cylindrical pegs 140 to clean up any pill remnants after the pill is crushed, as discussed in greater detail below.

Figure 2:
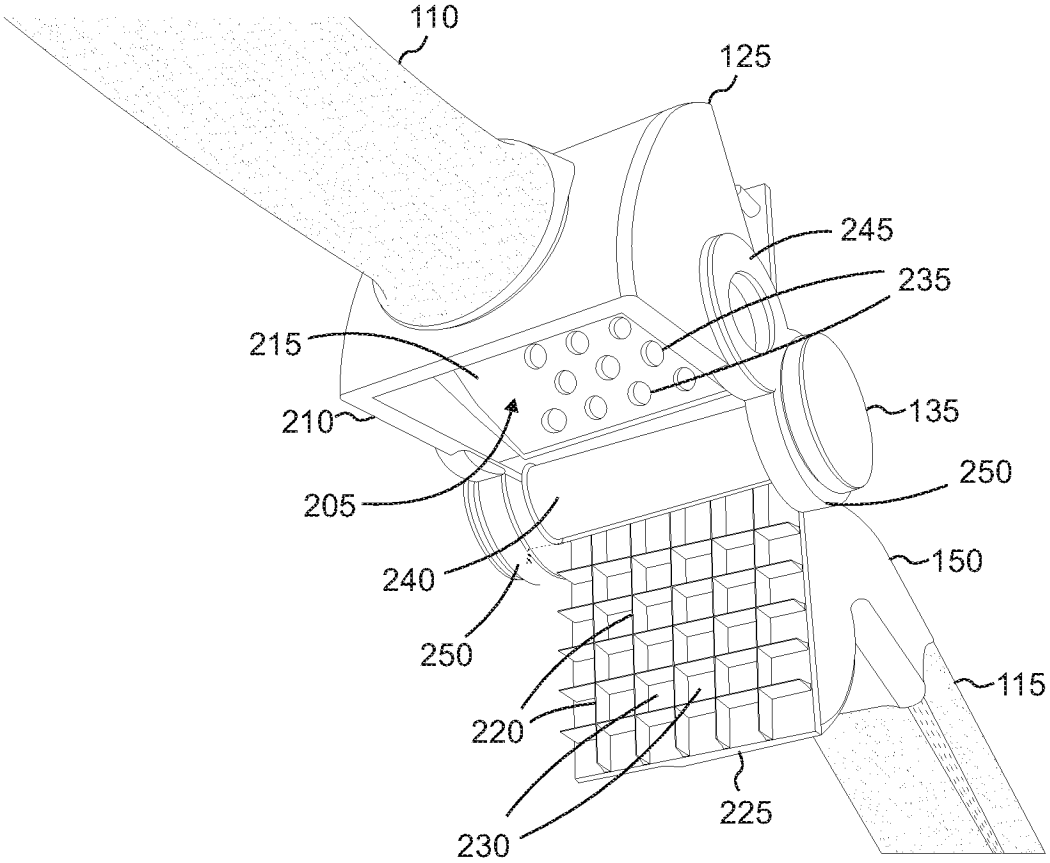
FIG. 2 shows an illustrative representation of fixed and movable jaws on the capsule cutter device.

FIG. 2 shows an illustrative representation in which attachment arms 245 attach to and extend from the fixed jaw 125 and encircle and attach to the cylindrical pin 240. Heads 135 of the cylindrical pin closes the ends to keep the attachment arms in place. Likewise, attachment arms 250 attach to and extend from the movable jaw 150 and encircle the cylindrical pin 240 and are kept in place by the head 135. The attachment arms 245 and 250 may be welded to the respective fixed and movable jaws or, in other implementations, may be secured using a screw and corresponding threaded hole. Likewise, the head 135 may be welded or threaded to the pin 240 depending on the implementation.

The bladed jaw section 150 includes a series of bladed edges 220 which extend upward from the platform 225. The bladed edges extend upward from the platform and creates internal recesses 230 between the bladed edges. While square-shaped bladed edges and recess are depicted in this implementation, other arrangements are also possible, such as triangular bladed edges and recesses, circular, rectangular, etc.

Below a plane 210 of the fixed jaw 125 is a pill cavity 205 inside which a pill can be placed for crushing using the bladed edges 220. The surface 215 of the cavity on the fixed jaw includes holes 235 through which remnants and debris from the crushed pill can escape for user access and consumption.

Figure 3:
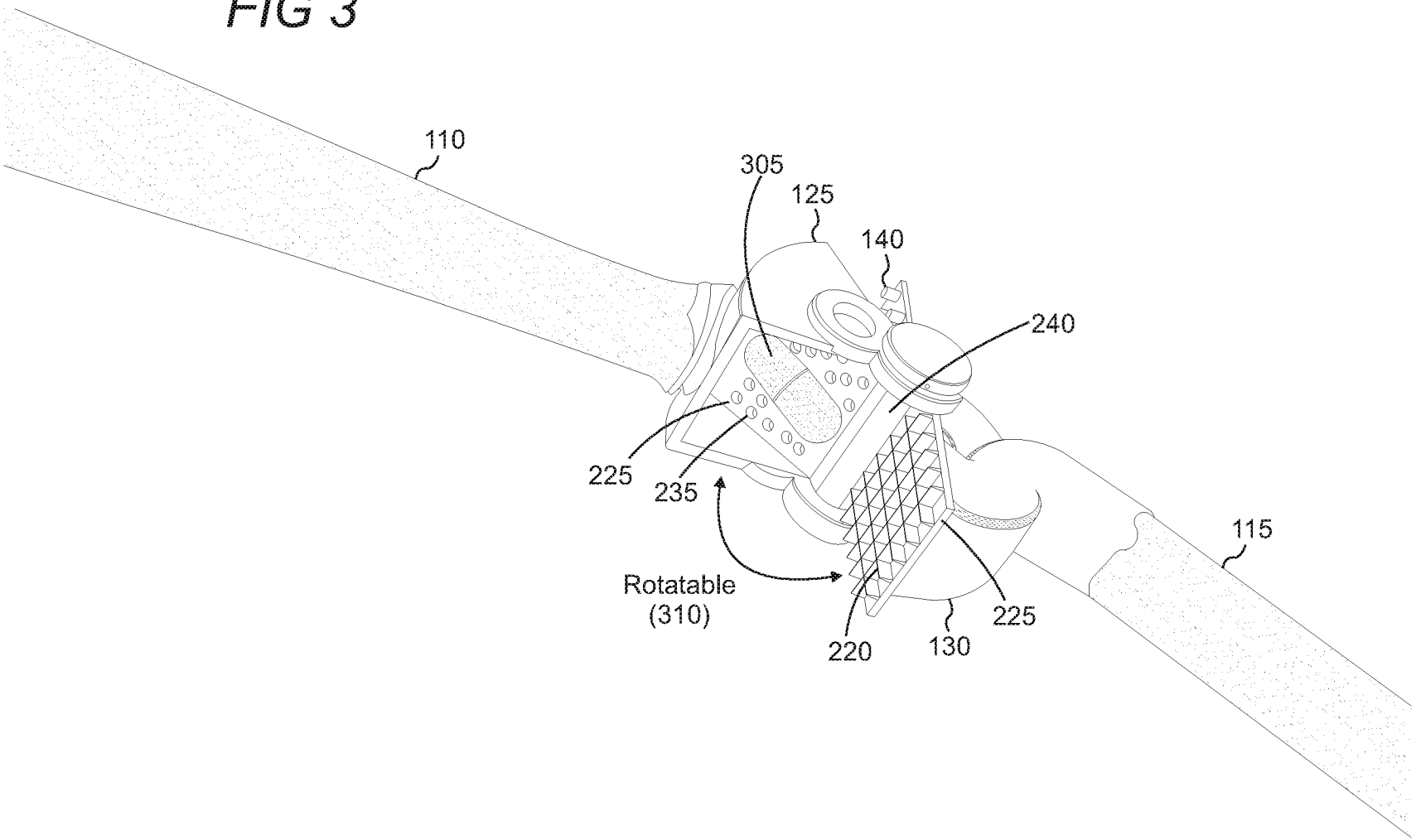
FIG. 3 shows an illustrative representation in which a pill is placed inside a cavity on the fixed jaw.

FIG. 3 shows an illustrative representation in which a pill 305 is placed on the surface 215 of the cavity 205. The bladed jaw section 150 of the movable jaw 130 rotates 310 toward the crushed pill responsive to receiving manipulation from a user. The size and shape of the surface 225 of the bladed jaw section corresponds to a size and shape of the cavity 205 of the fixed jaw 125, thereby enabling the bladed edges 225 to fully engage and crush the pill down to the cavity's surface 215.

Figure 4:
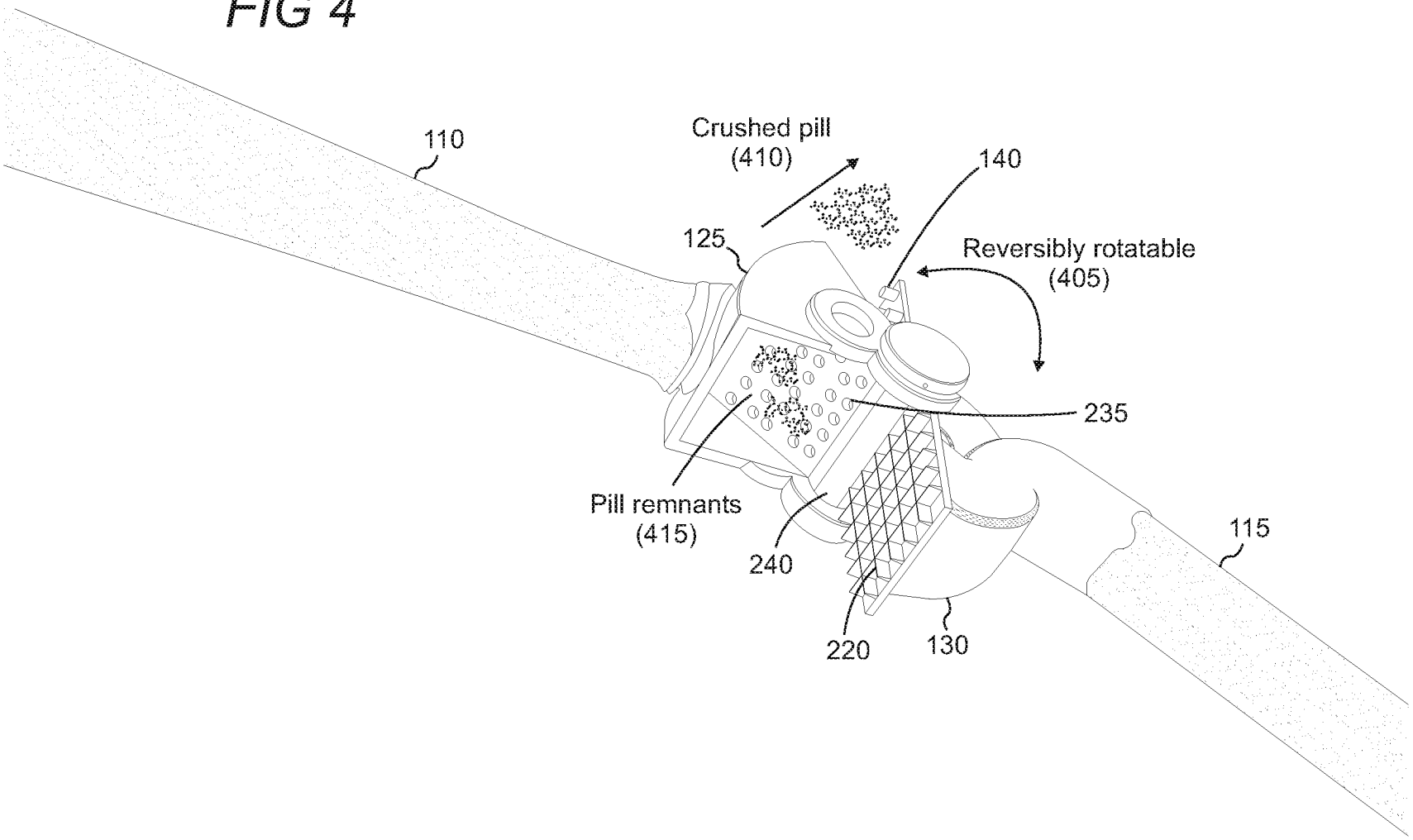
FIG. 4 shows an illustrative representation in which the pill is crushed using the bladed edges of the movable jaw.

FIG. 4 shows an illustrative representation in which the crushed pill 410 advances through the holes 235 on the cavity's surface 215 of the fixed jaw 125. The crushed pill can be placed directly into a user's mouth, a drink, food, or other means by which the user can ingest the pill. This can make ingesting the pill easier for people, such as young children or the elderly, who have trouble swallowing whole pills.

The capsule cutter device 105 can still be used to reversibly rotate 405 the movable jaw 130 to remove the pill remnants 415 still on the surface 215 or inside the holes 235 of the cavity 205. For example, the cylindrical pegs 140 correspondingly fit inside the holes to push out any leftover remnants from the pill. The user can push out any pill remnants and pick up the rest of the pill on the surface 215 of the fixed jaw 125 so that the user is still ingesting the correct dosage of medication. Thus, the capsule cutter device does not only make ingesting easier, but it is also configured to make sure no medication is lost and the user takes the proper dosage.

Disclosed are various embodiments for a capsule cutter device. In one example, a capsule cutter device is disclosed, which comprises: a fixed arm attached to a fixed jaw, wherein the fixed jaw forms a cavity and inside the cavity of the fixed jaw a capsule, pill, or tablet is received; and a movable arm attached to a movable jaw, in which the movable arm and the movable jaw open and close about a pin which enables the movable jaw to open and close relative to the fixed jaw, wherein the movable jaw includes bladed edges on a bladed jaw section that protrude from a platform which, when the movable jaw is in a closed position, engages with the cavity of the fixed jaw to cut the capsule, pill, or tablet positioned inside the cavity.

In another example, the capsule cutter device includes a cleanup jaw section attached to the movable jaw, in which a surface of the cleanup jaw section includes cylindrical pegs that also opens and closes by the movable arm, and wherein in the opened position the jaw with the cylindrical pegs engages with holes on a surface of the fixed jaw to eject left behind particles from the capsule, pill, or tablet. As another example, the movable jaw dually controls the bladed jaw section and the cleanup jaw section. As another example, the cylindrical pegs on the cleanup jaw section face an opposite direction of the bladed edges on the bladed edge section. In another example, the fixed and movable jaws rotate about a cylindrical pin positioned between the movable and fixed jaws. As another example, the platform on which the bladed edges are positioned on the bladed edge section of the movable arm is shaped and sized to correspond to a shape and size of the cavity on the fixed jaw, thereby enabling the bladed edges on the platform of the bladed jaw section to engage with the surface of the cavity on the fixed jaw. In another example, the bladed edges extend from each end of the bladed edge section's platform. In another example, the movable jaw and the movable arm bi-directionally rotate to enable the bladed jaw section and cleanup jaw section to engage with opposite sides of the fixed jaw's surface.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A capsule crusher device, comprising:

a fixed arm attached to a fixed jaw, wherein the fixed jaw forms a cavity and inside the cavity of the fixed jaw a capsule, pill, or tablet is received;

a movable arm attached to a movable jaw, in which the movable arm and the movable jaw open and close about a pin which enables the movable jaw to open and close relative to the fixed jaw, wherein the movable jaw includes bladed edges on a bladed jaw section that protrude from a platform which, when the movable jaw is in a closed position, engages with the cavity of the fixed jaw to cut the capsule, pill, or tablet positioned inside the cavity; and a cleanup jaw section attached to the movable jaw, in which a surface of the cleanup jaw section includes cylindrical pegs that also opens and closes by the movable arm, and wherein in the opened position the jaw with the cylindrical pegs engages with holes on a surface of the fixed jaw to eject left behind particles from the capsule, pill, or tablet.

2. The capsule crusher device of claim 1, wherein the movable jaw dually controls the bladed jaw section and the cleanup jaw section.

3. The capsule crusher device of claim 2, wherein the cylindrical pegs on the cleanup jaw section face an opposite direction of the bladed edges on the bladed edge section.

4. The capsule crusher device of claim 3, wherein the fixed and movable jaws rotate about the pin positioned between the movable and fixed jaws.

5. The capsule crusher device of claim 4, wherein the platform on which the bladed edges are positioned on the bladed edge section of the movable arm is shaped and sized to correspond to a shape and size of the cavity on the fixed jaw, thereby enabling the bladed edges on the platform of the bladed jaw section to engage with the surface of the cavity on the fixed jaw.

6. The capsule crusher device of claim 5, wherein the bladed edges extend from each end of the bladed edge section's platform.

7. The capsule crusher device of claim 6, wherein the movable jaw and the movable arm bi-directionally rotate to enable the bladed jaw section and cleanup jaw section to engage with opposite sides of the fixed jaw's surface.

* * * * *